United States Patent [19]

Raz

[11] 4,171,547

[45] Oct. 23, 1979

[54] TOILET-BLOW FLUSH SYSTEM AND DEVICES THEREFOR

[76] Inventor: Zeev Raz, 17 Keren Hayessod Str., Beer Sheva, Israel

[21] Appl. No.: 816,278

[22] Filed: Jul. 15, 1977

Related U.S. Application Data

[63] Continuation-in-part of Ser. No. 689,055, May 24, 1976, abandoned.

[30] Foreign Application Priority Data

Apr. 9, 1976 [IL] Israel ..... 49382

[51] Int. Cl.[2] ..... E03D 1/22; E03D 1/36

[52] U.S. Cl. ..... 4/326; 4/340; 4/366; 4/382; 4/384

[58] Field of Search ..... 4/324–326, 4/340, 345, 346, 353, 393, 395, 363–366, 405, 412–415, DIG. 1, 341, 342, 368, 378, 379, 381, 382, 384–386, 392

[56] References Cited

U.S. PATENT DOCUMENTS

| | | | |
|---|---|---|---|
| 1,037,679 | 9/1912 | Snyder | 4/363 X |
| 1,176,731 | 3/1916 | Balze | 4/345 |
| 1,323,703 | 12/1919 | Linfoot | 4/363 X |
| 3,041,630 | 7/1962 | Williams | 4/326 |
| 3,259,918 | 7/1966 | Walker, Sr. et al. | 4/DIG. 1 |
| 3,732,577 | 5/1973 | Moon | 4/415 |
| 3,766,571 | 10/1973 | Elder | 4/326 |
| 3,823,425 | 7/1974 | Coffman | 4/325 |
| 3,842,444 | 10/1974 | Gruenhagen | 4/324 |
| 3,936,889 | 2/1976 | Wibroe | 4/325 |

*Primary Examiner*—Stuart S. Levy
*Attorney, Agent, or Firm*—Holman & Stern

[57] ABSTRACT

A device for converting a single volume cistern into a cistern allowing both low-volume and high-volume flushes. The device includes a hollow vessel inserted in the cistern and at least partially surrounding the flushing mechanism and water outlet. An opening at the upper end of the vessel for the entry of water and at least one selectively openable port comprising a hinged door having a retaining lever arm attached at one of its ends to the door are provided. The arm and door are movable between a first closed position to a second displaced open position. The vessel forms an open ended water column extending above and around the water outlet to exclude a portion of the water in the cistern from passing through the outlet while the door is in the first position for low volume flushes. The door and the lever arm move to the second displaced open position with the lever held and restrained by interaction with a standard water-level responsive part. The arm forces the door, once opened, to remain in its open displaced position during the entire flushing action and until after completion thereof for high volume flushes, whereafter the arm is released from its displaced position. The door is adapted to automatically swing shut to its initial closed position by virtue of its own weight.

17 Claims, 5 Drawing Figures

TOILET-BLOW FLUSH SYSTEM AND DEVICES THEREFOR

This application is a continuation-in-part of an application entitled Toilet-bowl flush system and devices therefor, Serial No. 689,055 filed May 24, 1976 now abandoned.

The present invention relates to a selective toilet flushing arrangement and more particularly to a device for converting a single-volume flushing cistern into a selective volume flushing cistern adapted to selectively allow both low-volume and high-volume flushes.

Single-volume flushing cisterns known today have various mechanisms, There are manufactured and used, for example, in Israel today, flushing cisterns based on the siphon principle and cisterns having an outlet provided with a flushing valve including a seat and a valve member engageable with said seat and liftable therefrom wherein said valve is of the type utilizing an air bell, a buoyant ball valve or a rubber suction cup attachable to the lid of the cistern by vacuum pressure.

All of the above types of toilet flushing arrangements and others known in the art work in their various ways to achieve the same result upon actuation of their respective flushing mechanisms. As is known, upon actuation, the flushing mechanism of a water toilet is arranged to release a predetermined amount of water from the water cistern, which water rushes into the toilet bowl under the force of gravity and flushes waste materials contained in the bowl over a barrier into a discharge conduit that conducts them into a sewer. The amount of water consumed with each such flushing operation is usually substantial.

The common type of cistern contains not less than 6.5 liters of water (the Israeli standard is 9.5±0.5 liters) and on pressing a lever, pulling or pressing a knob, a lever is actuated which releases all the quantity of water in the cistern at once into the toilet bowl. The mechanism and its activating lever have a single-stage action and release the whole quantity of water contained in the cistern at each activation. Frequently, however, the amount of waste in a toilet bowl is very small and in fact in the majority of instances the only waste in the toilet bowl is liquid urine waste. Obviously on such instances it is unnecessary and wasteful to expend at least 6.5 to 9.5 liters, and even up to 5 gallons in larger American type cisterns, to flush liquid waste material from a toilet bowl especially in areas where water is in short supply.

With the increasing shortage of water in almost every country and especially in light of the increased awareness of the public with regard to the importance of the conservation of national resources such as water, people have sought, and means have been suggested, to reduce the quantity of water used in the flushing operation in general and the quantity of water used for flushing down liquids in particular. Thus, for example in some of the current flushing cisterns, when the user does not press the lever all the way, only a small portion of the water and not all the water in the cistern is released, and there are those who customarily release only a portion of the water in this way when flushing urine. This arrangement was not considered in the planning or the production of the flushing cistern and it is not efficient because the amount of water released by the partial activation is not fixed or regulated and if the user is not sufficiently agile the whole quantity of water is released. Moreover, it has the disadvantage that the user must keep his hand on the lever and wait until the desired quantity has been dispensed.

Some of the means suggested to reduce the amount of water used in general in the flushing operation are exemplified in the descriptions found in U.S. Pat. Nos. 3 259 918 and 3 732 577 in which there are described cup or box-like vessels adapted to surround the flush valve in a conventional cistern forming an open-ended water column extending upward around the valve assembly thereby preventing water stored in the base of the cistern outside the column and below the level of the upper edge or lip thereof from being discharged during flushing. These devices are mainly designed for the American type cisterns which hold up to 5 gallons of water in order to reduce the excessive amount of water used during every flush and are not useful for the European and Israeli cisterns which initially are designed to hold the minimum amount of water calculated by the regulating authorities of the respective countries to be ncessary to properly and completely flush solid waste. Furthermore, said devices, once installed, are not designed to allow selective flushing and in fact deliver a uniform reduced amount of water for every flush whether it be for solid or liquid waste.

Dual or selective flushing cisterns have been described in the prior art, e.g., in U.S. Pat. Nos. 2,351,672; 2,731,647; 2,864,095; 3,758,893 and 3,766,571. These patents, however, all operate on the same principle which involves replacing or substantially modifying the existing valve mechanism with a new and usually complicated and expensive two-level selective volume valve assembly for providing optional light and heavy flushes.

In contradistinction to the devices of said prior art patents and in accordance with the present invention there is now provided a simple inexpensive device which permits the conversion of an existing flushing cistern with a single-volume flush mechanism into a selective volume flush unit without introducing any alternations into the single flush valve mechanism itself. One of the major advantages of the devices of the present invention is that they are adapted to be simply installed by the average home owner himself without the need for professional help or expensive tools whereafter said device will act in concert with the existing flush mechanism to achieve the desired results.

Two prior art patents describe devices which proport to have a similar object and approach as the present invention but which have also been found not to achieve the desired results.

In U.S. Pat. No. 3,842,444 there is described and claimed an apparatus for selectively producing a high volume flush or a low volume flush which apparatus comprises barrier means comprising a vertically extending water impervious sleeve for surrounding a flush ball valve and sealing against the bottom of said tank excluding a portion of the water in the water tank from passing through said flush ball valve, wherein said barrier means is buoyant when immersed in water, support means for permitting limited guided vertical movement of said barrier under the influence of the buoyancy of said barrier to lift said barrier out of sealing engagement with the bottom of said tank and permitting substantially all of the water in said tank above the level of said valve to pass under said barrier and through said valve, and latch means on said barrier for releasably securing said barrier in said sealing position.

Similarly in U.S. Pat. No. 3,041,630 there is described and claimed a different form of device embodying a water closet valve comprising a basically cylindrical open-ended housing having one end thereof disposed on the bottom of a water closet tank and surrounding the flush valve seat therein in substantially concentric spaced relation thereto, the said housing being disposed vertically upward therefrom to a height less than the normal full level of the tank is condition for flushing, a flushing lever positioned above the upper extremity of the said housing within the said water closet tank and communicating with a flushing handle mounted exteriorly of the said tank, a buoyant ball valve aligned with the said housing, a resilient mounting communicating with the said buoyant ball valve and having its uppermost extremity mounted on the flushing lever, and a gate valve pivotally mounted proximate the lower extremity of the said housing and opening inwardly thereinto.

As is recognized in the art one of the major problems involved in producing a selective volume flushing cistern is that of finding suitable means for effecting the timely opening and the timely and automatic closing of the openable port which is opened to allow the complete discharge of water from the cistern.

In both U.S. Pat. Nos. 3,842,444 and 3,041,630 automatic means for closing the openable port, i.e., to close the gate valve or lower the barrier are described, however, in both of the above patents the preferred embodiments described, and in fact the only means described for effecting the automatic closing of the openable port, involve the lowering of the barrier in U.S. Pat. No. 3,842,444 and the closing of the gate valve in U.S. Pat. No. 3,041,630 as a direct result of the automatic descent of an auxiliary buoyant float or of the buoyant float of the flushing mechanism respectively.

Systems of the above type wherein the openable port is closed as a direct result of the descent of the flushing mechanism float or of an auxiliary float have now been found to suffer from the disadvantage of having the openable port prematurely begin to close before substantially all the water has exited from the cistern. This premature partial closing of the openable port results in the restriction of the discharge flow rate of the final portion of water below that necessary to achieve the final surge of water which very often is instrumental in properly and completely flushing all of the solid wastes contained in the toilet bowl over the barrier and into the discharge conduit.

Similarly this inter-dependency of the openable port and a flushing mechanism or auxiliary float often results in a premature substantially complete closing of the openable port before substantially all the water has exited from the cistern and the non-utilization of said remaining water in the flushing process.

It is an object of the present invention to provide a device for converting a single-volume flushing cistern into a selective volume flushing cistern wherein during the high-volume discharge of water from the cistern the water exits at a substantially constant discharge rate and volume which will not fluctuate from use to use and which is not influenced by the descent of the water level during the flushing action. Another object of the present invention is to provide a simple and inexpensive device which is easily installable.

Thus in accordance with the present invention there is now provided a device for converting a single volume cistern into a selective volume cistern adapted to selectively allow both low volume and high volume flushes wherein said single volume-cistern is of the type having a water inlet, a water outlet, a valve mechanism operationally linked to a float lever mechanism for controlling the amount of water flowing into the cistern, a flush actuating means and a flushing mechanism operationally linked to said water outlet, said device comprising a hollow vessel adapted to be inserted in said cistern and to at least partially surround the flushing mechanism and water outlet thereof, said vessel being provided with an opening at its upper end for the entry of water therethrough and with at least one selectively openable port wherein said openable port comprises a hinged door having a retaining lever mechanism, said lever mechanism comprising a lever arm attached at one of its ends to said door, wherein said door and said lever arm are adapted to move between a first closed position to a second displaced open position, said vessel forming an open ended water column extending above and around said water outlet to exclude a portion of the water in said cistern from passing through said outlet while said door is in said first position for low volume flushes and wherein said door and said lever arm are adapted to be moved to said second displaced open position and said lever mechanism is adapted at its other end to be held and restrained by interaction with a standard water-level responsive part of said single-volume cistern whereby said arm is adapted to force said door, once opened, to remain in its open displaced position during the entire flushing action and until after the completion thereof for high volume flushes, whereafter said arm is released from its displaced position and said door is adapted to automatically swing shut to its initial closed position by virtue of its own weight.

The term standard water-level responsive part of said single volume cistern as used herein is intended to refer to those parts of the cistern listed hereinbefore which in fact are responsive to the water level in the cistern. Thus, for example, in the most preferred embodiment described hereinafter the lever mechanism is adapted to interact with the water-level responsive float lever while in a second preferred embodiment the lever mechanism is adapted to interact with a flushing valve mechanism of the type which is responsive to the lowering of the water level in the cistern and which is adapted upon the emptying of substantially all the water in the cistern in response thereto to complete the flushing action by reseating a valve closing means over the water outlet of said cistern.

As will be explained and described in detail hereinafter the function of the float lever as the most preferred retention means in the present invention is diametrically opposite from its use in prior art patents wherein the descent of the float during the flushing operation resulted in the closing of the openable port since in the present invention as will be described it is the ascent of the float after the flushing action has ceased and the cistern has begun to refull which results in the closing of the hinged door.

Similarly in the embodiment which interacts with the flushing mechanism as will be described it is only upon completion of the flushing action that the hinged door is released from its open displaced position thereby overcoming the prior art deficiency of premature partial and even complete closing of the openable port.

For these and other reasons the devices according to the present invention constitute a major advance over prior art devices in reliability, simplicity and operation performance.

As stated hereinbefore devices of the present invention, with minor variations dictated by the existing flushing mechanism and structure of the cistern in which they are to be installed, can be adapted for installation in almost all types of existing flushing cisterns.

Thus, for example, a device according to the present invention, adapted for interaction with the flushing mechanism of the cistern could be used with any valved mechanism having an upwardly extending member which is adapted to ascend upon actuation of the flushing mechanism and to descend upon the completion of the flushing action such as those cisterns having air-bell, bouyant ball or suction cup type flushing mechanisms. Since the air-bell type mechanism is the most common type of mechanism manufactured in Israel today embodiments of the present invention will be described with reference thereto, it being understood that said reference is illustrative only and nonlimitative.

Similarly it will be realized that embodiments of the present invention which are adapted to interact with the float lever could be adapted to operate not only in conjunction with valved flushing mechanisms but also with a siphonic cistern of the type required for use in England and partially in use in Israel, by placing the vessel of the present device around the intake or inlet of the siphon in which case the term flushing mechanism and water outlet of the cistern as used herein is intended to refer to said siphon inlet.

The vessel according to the present invention is mounted in such a way that the lower part of the valve mechanism, or the lower part of the suction section in case of a siphon mechanism, which as is known has no valve, will be functionally surrounded by the vessel. By selective use of the device the user is able, at will, with the aid of the vessel, to fool the flushing mechanism into assuming that the water has already left the flushing cistern and thereby to cause the automatic stopping of any further emptying of the cistern when in fact only the water above and in the vessel have been utilized as will be explained more fully hereinafter and thereby to achieve low volume flushes.

In the preferred embodiments designed and adapted for use with Israeli and European cisterns of relatively small capacity the devices preferably comprise a hollow vessel insertable into the flushing cistern and adapted to normally rest on the bottom of said cistern wherein the opening of said hinged door and the actuation of the flushing mechanism result in the utilization of substantially all the water contained in the cistern as well as the water enclosed in the vessel for the flushing action, and with reference to which arrangement the term high volume flushes relates to substantially complete flushing.

On the other hand while devices of the present invention are normally adapted to rest on the bottom of the cistern, they can obviously be installed in the larger capacity U.S. type cisterns atop the cup or box-like vessels of the type exemplified in U.S. Pat. Nos. 3,259,918 and 3,732,577 described hereinbefore to allow both partial and complete flushes of the water stored in the cistern above the level of the upper edge or lip of the column formed by said cup or box-like vessel which upper edge or lip form and constitute the effective water outlet of the cistern as far as the device of the present invention is concerned.

In such an arrangement and as will be described more fully hereinafter the term high-volume flushes relate to the utilization substantially of only the water within said cup or box-like vessel and the water above the upper edge thereof while the term low volume flush relates to the utilization of the water within said cup or box-like vessel, the water within the hollow vessel of the present invention and the water contained in the cistern above the level of the opening at the upper end of the vessel of the present invention.

It will be understood that manufacturers can readily produce cisterns having the devices of the present invention installed therein and the present invention is also directed to a flushing cistern whenever provided with a device according to the present invention.

The term partially surround as used herein with reference to the vessels of the present invention is intended to denote that the vessel does not have to, and in fact doesn't extend all the way up to the full height of an upright flushing mechanism which it surrounds, such as an air bell or suction cup-valve mechanism; need not completely surround a convoluted and horizontally extending flushing mechanism such as a siphon, and in fact can be a slotted vessel and therefor by definition not completely circumferentially surround the flushing mechanism.

Furthermore the vessel utilized in the devices of the present invention may be made of any material, although plastic is preferred and its superficies may be a cylinder of elliptical cross-section a truncated cone, a prism of square or rectangular cross-section or any other hollow geometrical shape as well as incomplete geometric shapes such as slotted hollow tubes, although for ease of manufacture vessels of substantially rectangular cross-section are preferred.

The present invention is also directed to a device incorporating a vessel as described in combination with a dual actuating means for the flushing mechanism of the cistern in which the device is installed, which dual actuating means is adapted to replace the regular flush actuating means of said cistern.

The first of said dual means preferably comprises a mechanism for actuating the flushing mechanism and the second of said actuating means comprises a mechanism adapted to effect the pivotal displacement of said hinged door and to actuate the flushing mechanism, the arrangement being such that upon insertion of said device in said cistern and upon actuation of said first flush actuation means said door remains in its closed position and the flushing action mainly utilizes only the water enclosed in the vessel and the water contained in the cistern above the level of said opening at the upper end of the vessel, while upon actuation of said second actuating means said door is opened and said flushing mechanism is activated whereupon said retaining means are adapted to retain said door in its open position until after the completion of the flushing action, thereby allowing the rapid entrance of the water containing in the cistern through said door opening and out the water outlet of the cistern whereby substantially all the water contained in the cistern above the lower edge of said openable port as well as the water enclosed in the vessel is utilized for the flushing action, whereafter said retaining means are adapted to automatically release said door from its open position to enable its return to its initial closed rest position.

In such a device said second actuating means can preferably comprise a lever coupled at one end to a handle adapted to actuate the flushing mechanism and having its other end extending adjacent the hinged door of said vessel and adapted to push thereagainst and effect the pivotal displacement thereof or a lever coupled at one end to a handle and having its other end provided with a plurality of spaced holes adapted to receive and pull a chain attached to the hinged door of said vessel.

In order that the invention may be more fully understood reference should be had to the following illustrative description read in conjunction with the accompanying drawings in which.

With specific reference now to the figures in detail it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard no attempt is made to show structural details of the system and its apparatus in more detail than is necessary for a fundamental understanding of the invention the description taken with the drawings making apparent to those skilled in the art how the several forms of the invention may be embodied in practice.

Figure 1:
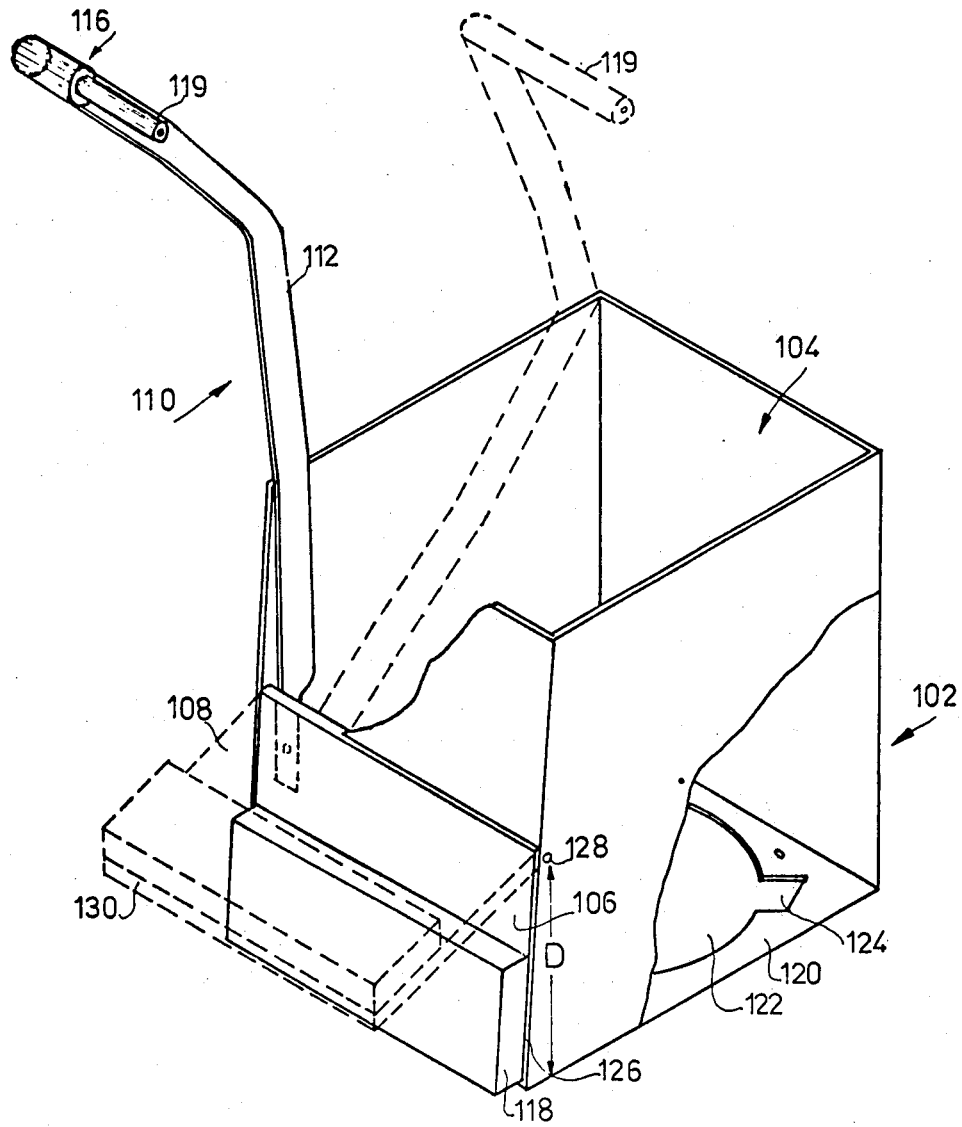
FIG. 1 is a perspective view of a preferred vessel according to the present invention with part of its front and side wall broken away to disclose features of the bottom and retaining lever mechanism thereof.
Figure 3:
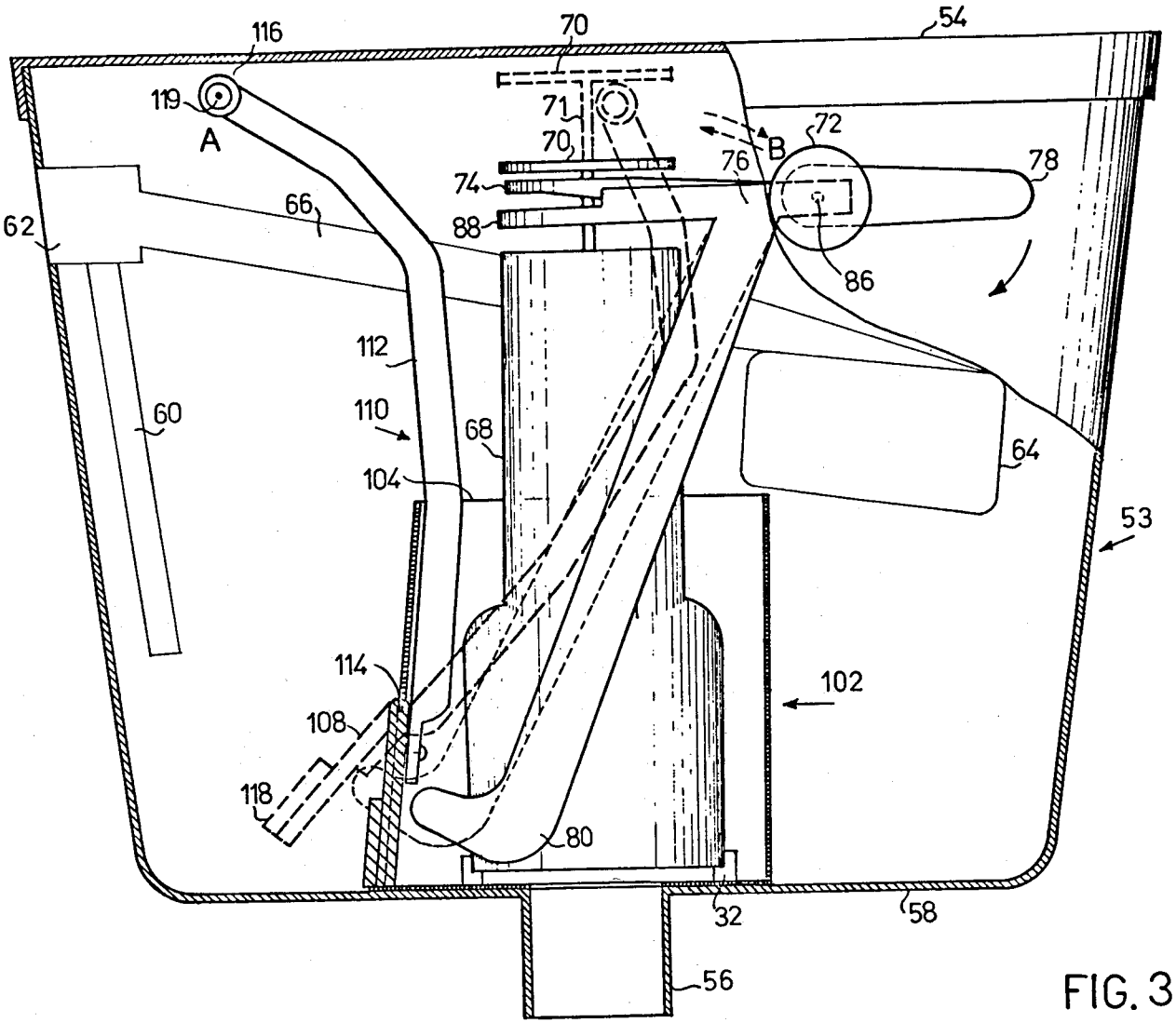
FIG. 3 is a sectional view of a standard air bell valve operated cistern into which a device according to the present invention as shown in FIG. 1 has been incorporated.

Referring first to FIG. 1 there is shown a device adapted for insertion in a cistern having an air-bell, bouyant ball or suction cup flushing mechanism of the type having an upwardly extending member which is adapted to ascend upon actuation of the flushing mechanism and to descend upon the completion of the flushing action. Said device comprises a hollow vessel 102 provided with an opening 104 at its upper end for the entry of water therethrough and with at least one openable port 106 at its lower end wherein said openable port comprises a hinged door 108 having a retaining lever mechanism 110 comprising a lever arm 112 attached at one of its ends 114 (as shown in FIG. 3) to said door 108.

Said door 108 and said lever arm 112 are adapted to move from a first closed position shown in solid lines to a second displaced open position shown in broken lines and said lever mechanism 110 is adapted at its other end 116 to be held and restrained by interaction with said upwardly extending member of the water-level responsive flushing mechanism as will be described in detail with reference to FIG. 3.

In preferred embodiments of the present invention said door 108 will be non-buoyant and preferably weighted e.g. by attachment of a weight 118 as shown, or by manufacture of the door itself from a heavy material to assure its ability to swing shut to its initial closed position by virtue of its own weight and the influence of gravity thereon.

Preferably the free end 116 of said lever arm is provided as shown with a depending flange 119 which is adapted to abut against and be restrained by said upwardly extending member of the flushing mechanism in its ascended position.

As will be understood the vessel can be a tubular body open at both ends wherein upon insertion of the vessel into the cistern the bottom of the cistern serves as a common bottom to both the vessel and the cistern. This possibility is especially envisioned in the cases in which manufacturers will manufacture cisterns with the device of the present invention forming an integral part thereof.

Figure 2:
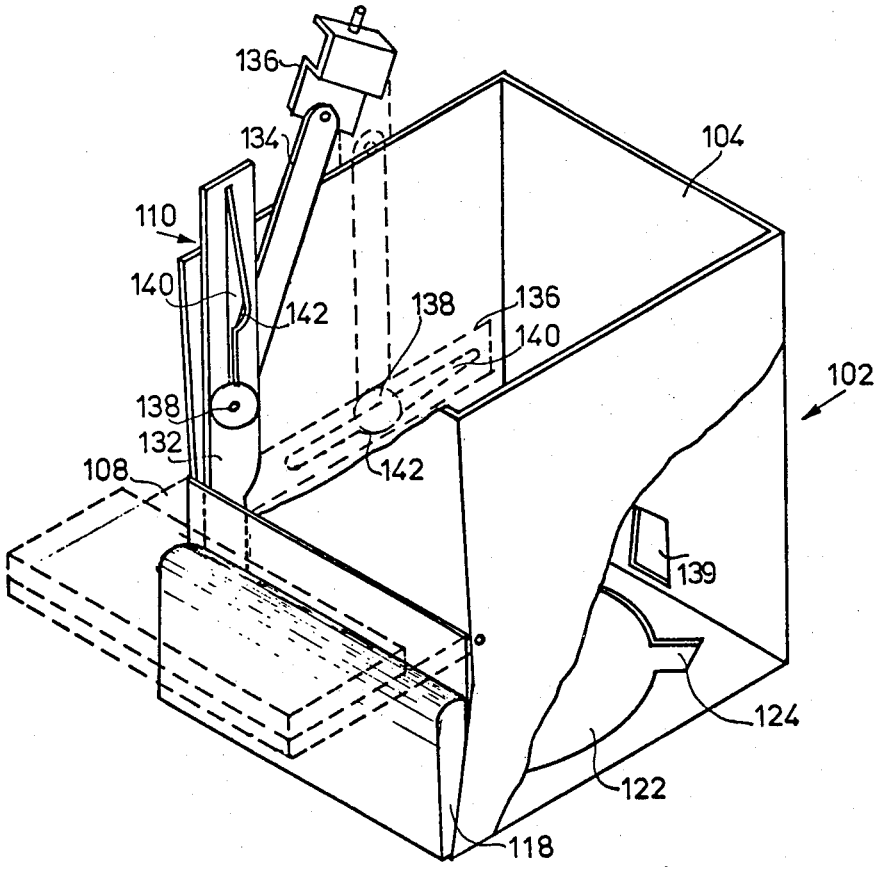
FIG. 2 is a perspective view of a different preferred vessel according to the present invention with part of its front and side wall broken away to disclose features of the bottom, back and lever mechanism thereof.

Alternatively and as can clearly be seen with reference to FIGS. 1 and 2 said vessel 102 can comprise an integral bottom surface 120 having a water outlet opening 122 therein. Said water outlet 122 of the vessel is adapted to be of equal or greater area than the opening of the cistern water outlet so as to neither restrict the flow of water therethrough nor restrict the free movement of the valve of the flushing mechanism which it surrounds.

Figure 4:
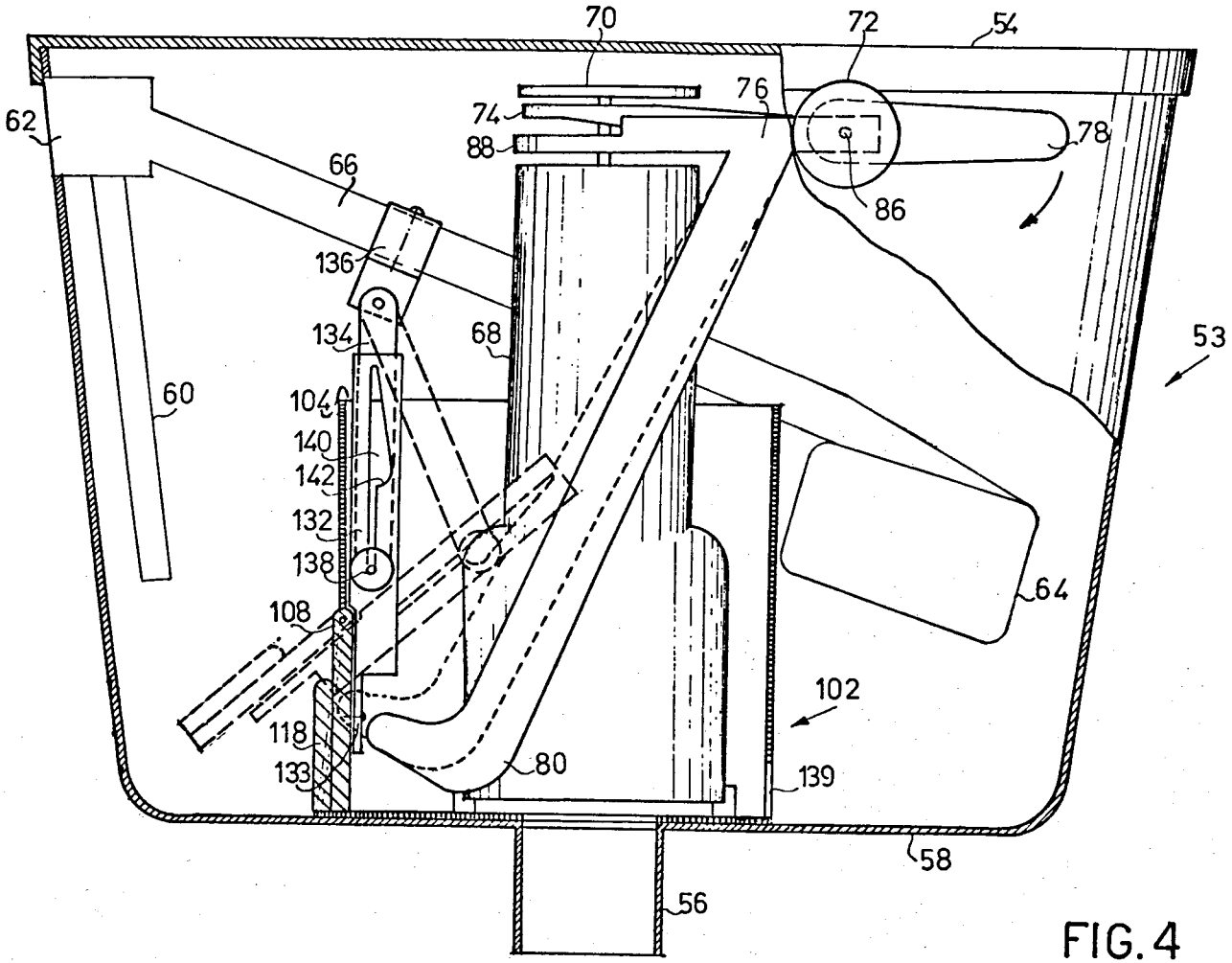
FIG. 4 is a sectional view of a standard air bell valve operated cistern into which a device according to the present invention as shown in FIG. 2 has been incorporated.

When the vessel is manufactured separately from the cistern it is preferable for said vessel to comprise means for affixing said vessel in said cistern. Thus, for example, since the standard cistern illustrated in FIGS. 3 and 4 is manufactured with projections 32 extending from the bottom thereof, the vessels shown in FIGS. 1 and 2 were prepared for attachment therein by the provision of complementary apertures 124 in the bottom of said vessels adapted to engage said projections.

Another possibility is to manufacture a specially designed vessel bottom comprising a downwardly extending connector pipe adapted to tightly fit through the water outlet of said cistern and upwardly extending projections positioned around the water outlet opening of said bottom and adapted to engage and support the bottom of an air-bell flush mechanism provided in said cistern.

While not shown, such a multipurpose bottom should provide many advantages including a saving in component parts to manufactures wishing to produce cisterns already incorporating devices according to the present invention.

While the door 108 can be adapted to engage any point of its frame 126 in the preferred embodiment shown said hinged door is adapted when shut to engage the vessel bottom 120 in a tight friction fit. This friction-fit relationship is preferably established by manufacturing the hinged door and frame in such a manner that the vertical distance D from the hinged door's pivot point 128 to the inner surface (not shown) of the vessel bottom 120 is less than the distance from said pivot point 128 to the edge 130 of the free end of said door.

Referring now to FIG. 2 in which like numerals have been used to designate like parts there is shown an especially preferred embodiment of the present invention wherein the lever mechanism 110 comprises a lever arm 132 attached at one end 133 to said door (as shown in FIG. 4) and a linking arm adapted to be attached e.g., by attaching means 136 to the float lever of the cistern wherein said lever arm 132 and said linking arm 134 are pivotally and slidingly coupled at their respective free ends 136 and 138 to each other.

This embodiment is most preferred since it is controlled by the position assumed by the float lever in such a way that said lever mechanism is adapted to release lever arm 132 and the hinged door 108 from its open displaced position shown in broken lines to enable its return to its initial closed rest position as shown in solid lines upon the refilling of the cistern and the effect of the rise in water level in said cistern on said float lever after the flushing mechanism has automatically closed the water outlet. This arrangement is especially preferred because it assures that during a desired complete flushing action the hinged door remains open not only until the completion of the flushing action but for a period thereafter as well, thus assuring that the openable port door cannot close until the cistern has substantially refilled after the completion of the flushing action.

Also as shown with reference to FIG. 2 said vessel is preferably provided with at least one constantly open port 139 opposite said selectively open port which port 139 is made relatively small and whose main function is to assure that once the water outlet of the cistern is closed, the water refilling the cistern will immediately begin filling the vessel 102 as well, so that it will not be necessary to wait for the water level in the cistern to reach the opening 104 at the upper end of said vessel before said vessel is refilled for low volume or partial flushes. Of course said constantly open port can be of different shape, size and location from the port 139 illustrated.

The action and interaction of the above described vessels will be more fully understood from the following detailed description with reference to FIGS. 3 and 4.

Referring first in general to said figures the reference number 53 designates a standard cistern of a toilet which is covered at the top by a detachable lid 54 and which has a water outlet 56 in its bottom 58. The cistern includes an inlet (not shown) whose outflow into the cistern through depending pipe 60 is controlled by a valve mechanism 62. When outlet 56 is closed the water flowing into the cistern reaches a level predetermined by a float 64 attached to the end of a lever arm 66 which controls the opening and closing of valve mechanism 62. As is known in normal operation of such cisterns when the float 64 at the end of lever arm 66 reaches a predetermined level, the arm closes valve mechanism 62 and the flow of water into the cistern terminates leaving the cistern filled with water up to said predetermined level. In the cistern shown the flushing mechanism comprises a standard air-bell valve 68 seated over said water outlet 56 and having an actuating head 70 adapted to be lifted. When the toilet is to be flushed the outlet 56 is opened thereby permitting the water in the cistern to rush into the toilet bowl (not shown) and to flush waste material contained therein. After substantially all the water has drained from the cistern the vacuum which was created between the two inverted cups which form the air-bell upon the lifting or the actuating head 70, is broken by the entrance of air and the valve thereof automatically reseates itself over outlet 56. In the interim the cistern already begins to fill up again with water because descent of the float 64 has meanwhile opened the water supply valve 62.

As stated in the preferred devices according to the present invention there is further provided a dual actuating means for said flushing mechanism which is adapted to replace the regular flush actuating means of said cistern. In the illustrated embodiment the first of said means comprises a mechanism for actuating the flushing mechanism as standardly found in such cisterns comprising a flushing knob 72 linked to a flushing lever 74 adapted to lift the actuating head 70 of the air-bell valve.

The second of said actuating means comprises a mechanism adapted to effect the pivoted displacement of the hinged door 108 of the vessel and to actuate the flushing mechanism and comprises a lever 76 coupled at one end to flushing handle 78 and having its other end 80 extending adjacent the hinged door of said vessel and adapted to push thereagainst and effect the pivotal displacement thereof.

In practice when flushing handle 78 is pulled in the direction of the arrow, lever 76 pivots around pivot point 86 and a section 88 of said lever serves to lift the actuating head 70 of the air bell valve while the end 80 of said lever moves to the position shown in broken lines and gives the hinged door 108 a sufficient kick to dislodge it from its friction fit in openable port 106 whereafter the door swings open and is retained in its open position by the retaining lever mechanism 110 thereby allowing the rapid entrance of the water contained in the cistern through said openable port 106 and out the water outlet of the cistern whereby substantially all the water contained in the cistern as well as the water enclosed in the vessel is utilized for the flushing action, whereafter said retaining lever mechanism 110 is adapted to automatically release said door from its open position to enable its return to its initial closed rest position as described hereinafter.

Referring to the above description with reference to FIG. 3 it will now be understood that the arrangement of the device is such that upon insertion of said device in said cistern and upon actuation of said first flush actuation means 72,74 said door remains in its closed rest position and the flushing action mainly utilizes only the water enclosed in the vessel and the water contained in the cistern above the level of said opening 104 at the upper end of the vessel, while upon actuation of said second actuating means 78,76, and 80 said door is opened and the free end 116 of said lever mechanism is adapted to pass from closed position A over the head 70 of said bell valve 68 to position B whereafter the actuation of said flushing mechanism by the lifting effect of section 88 of flush actuating lever 76 on said head 70 results in the complete ascent of said head to the position shown in broken lines and its blockage of the return of said lever arm 112 by interaction between depending flange 119 situated at the free end 116 of said lever arm and stem 71 of said actuating head 70 until the completion of the flushing action, whereupon the descent of said head serves to release said arm from its displaced position, indicated by broken lines, which in turn permits said door to swing shut under its own weight.

While the described device can be used as explained with a flushing mechanism having upwardly extending members without heads, such as bouyant ball mechanisms, when used with mechanisms such as the bell valve which has a head 70 on a stem 71 said arm lever is preferably provided with a depending flange 119 which not only is adapted to be held and restrained in its displaced position by the stem 71 of said actuating head 70 but which also is adapted to be responsive to and be pushed away from said stem 71 by said head, back to position B, upon the descent of said head at the completion of the flushing action whereafter said flange is adapted to be able to swing freely over said activating head as the door 108 swings shut to its initial closed position by virtue of its own weight and the influence of gravity thereon. Thus said flange 119 is adapted and designed to facilitate its sliding out from under said head 70 as said head descends by angling said flange or by providing a freely rotatable element concentrically mounted on said flange as shown more clearly in FIG. 1.

Referring now to the more preferred embodiments of the present invention which are adapted for use with cisterns having any type of flushing mechanism and which are adapted to interact with the float lever of the cistern reference is directed to the device illustrated in both FIGS. 2 and 4.

As seen in the preferred embodiment illustrated said lever arm 132 is provided with a slot 140 and said linking arm 134 is slidingly and pivotally coupled at its end 138 to said lever arm slot 140. Preferably said lever arm is provided with a slot 140 having a notch 142 against which, and preferrably against which notch 142, said linking arm is adapted to bear when the door is in its displaced position, which position is shown in broken lines. Said notch 142 when provided is so positioned in said slot 140 and with reference to said door 108 as to assure the transmission of an adequate moment of force along said lever arm 132 to maintain said door in its open position.

As will be seen in FIG. 4 the arrangement is such that when the door is in its closed position the linking arm 134 is adapted to slide alongside said lever arm 132 when said float lever 66 descends, while when the door is in its displaced open position as shown in broken lines said linking arm is adapted to bear on said lever arm whereby said lever arm is adapted to force said door to remain in its open displaced position until the ascent of the float lever, and the linking arm attached thereto, upon the refilling of the cistern allows the release of said lever arm from its displaced position and the closing of said door.

Referring to the above description with reference to FIG. 4 it will now be understood that the arrangement of the device is such that upon insertion of said device in said cistern and upon actuation of said first flush actuation means 72, 74 said door remains in its initial closed rest position and the flushing action mainly utilizes only the water enclosed in the vessel and the water contained in the cistern above the level of said opening 104 at the upper end of the vessel, since in the closed position of the door 108 the linking arm 134 is adapted to slide alongside said lever arm 132 to the position shown in solid lines when said float lever 66 descends and in fact to contribute to the maintenance of the door in its closed position further assuring the creation of only a partial flushing action for liquid wastes.

Upon actuation, however, of said second actuating means, lever 76 pivots around pivot point 86 and section 88 of said lever serves to lift the actuating head 70 of the air bell valve while the end 80 of said lever simultaneously moves to the position shown in broken lines and gives the hinged door 108 a sufficient kick to dislodge it from its closed position whereafter the door 108 and the attached lever arm 132 swing open and the end 138 of said linking arm 134 bears against the notch 142 of the slot 140 of said lever arm 132 as a result of the descent of float lever 66 and retains said door in its open position as shown in broken lines. This open position of the door allows the rapid passage of the water contained in the cistern through the opening 104 at the upper end of the cistern, through the opened port in the vessel created by the opening of door 108 and even via constantly open port 139 and out the water outlet 56 of the cistern whereby substantially all the water contained in the cistern as well as the water enclosed in the vessel is utilized for a complete flushing action. After substantially all the water has emptied from the cistern the bell valve reseats itself and the cistern begins to refill with water whereafter the ascent of the float lever 66 and the resulting ascent of linking arm 134 attached thereto allows the release of said lever arm 132 from its displaced position and the closing of the door 108 by the virtue of the weight of said door as augmented by weight 118 and the influence of gravity thereon. Once said door is closed the cistern is once again ready to be selectively used for a low volume or a high volume flush as described.

While in the preferred embodiment shown said notch 142 is in fact a stepped notch and the arrangement is such that when the door is in its displaced open position said linking arm 134 is slidingly guided by said slot to bear against said stepped notch, in fact any notch and even no notch in the slot will still result in the desired effect since the distribution of vector forces are such that once said door and lever arm are displaced said linking arm will automatically bear against said lever arm and maintain it in its displaced position upon the descent of the float lever, although as stated, provision of a notch assures the transmission of an adequate moment of force along said lever arm.

With reference to the embodiment which will be described hereinafter in greater detail with specific reference to FIG. 5, the device described constitutes an embodiment specifically designed for large capacity US type cisterns in which a high volume flush using all the water in the cistern is undesirably and unnecessary even for flushing solid wastes. Consequently it is intended and envisioned that devices according to the present invention can be adapted to be attached atop and shaped as to form a contiguous outer surface with the outer surface of a first sleeve-like vessel of oval, polygonal or any of the shapes described in U.S. Pat. No. 3,259,918 and described or mentioned in U.S. Pat. No. 3,732,577 wherein said prior art sleeve, which has already been installed in hundreds of thousands of cisterns in the US continues to serve its intended function of forming an open ended water column extending upward around the valve assembly thereby preventing water stored in the base of the cistern outside the column from being discharged during flushing while the device according to the present invention is adapted in its position atop said first sleeve to selectively allow both low volume and high volume flushes drawing substantially only from the water within said first sleeve and the water above the upper edge thereof.

Alternatively for US type cisterns in which such sleeves have not yet been installed it is intended and envisioned that devices according to the present invention will be manufactured with a hinged door positioned in the side of said vessel at a distance removed from the bottom thereof as shown with reference to FIG. 5 as opposed to the vessels described with reference to FIGS. 1–4 wherein said vessels are provided with hinged doors at their lower ends as shown.

Figure 5:
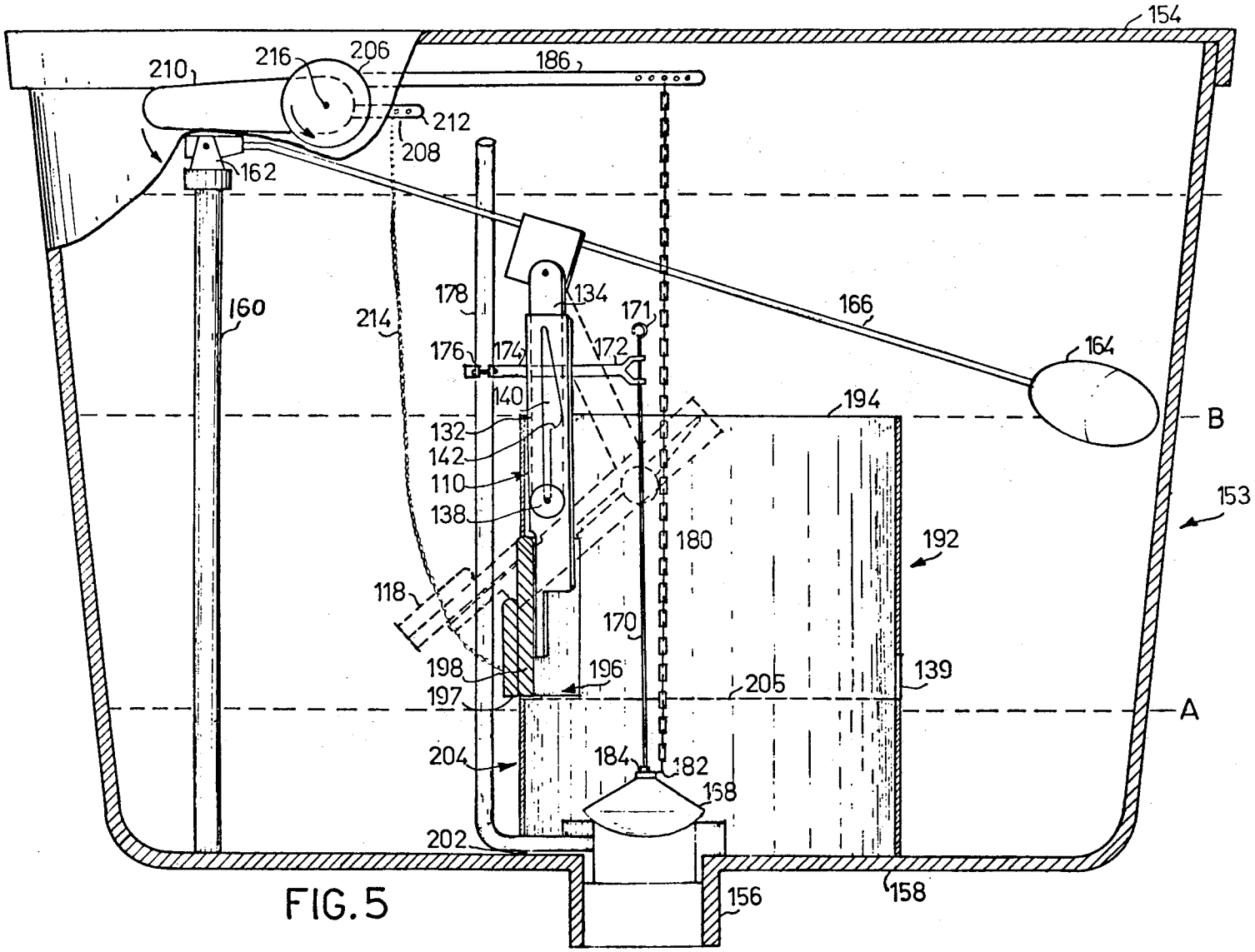
FIG. 5 is a sectional view of a standard US type flush-ball valve operated cistern into which a vessel according to the present invention has been incorporated.

Referring now to FIG. 5 the reference number 153 designates a standard cistern of a toilet which is covered at the top by a detachable lid 154 and which has a water outlet 156 in its bottom 158. The cistern includes an inlet pipe 160 whose outflow into the cistern is controlled by a valve mechanism 162. When outlet 156 is closed the water flowing into the cistern reaches a level predetermined by a float 164 attached to the end of a lever arm 166 which controls the opening and closing of valve mechanism 162. In the cistern shown the flushing mechanism comprises a simple flush ball valve 168 seated over said water outlet 156. A vertical stem 170 is screwed into the upper end of ball valve 168, the upper end of said stem being in the form of a loop 171, said stem passing through openings in yoke 172 of fitting 174 which is clamped by a screw 176 around the upper end of overflow stand pipe 178. A chain 180 connected to loop 182 which in turn is attached at the upper end of valve 168 beneath shoulder 184 is connected at its upper end to flushing lever 186.

In such a cistern there is shown installed a hollow vessel 192 of substantially oval cross-section according to the present invention provided with an opening 194 at its upper end for the entry of water therethrough and with at least one openable port 196 wherein said openable port comprises a hinged arcuate door 198 having a retaining lever mechanism 110 (as described with reference to FIGS. 2 and 4) attached thereto. As explained the vessel of the present embodiment has been modified for large capacity US type cisterns wherein the hinged door 198 is positioned in the side of said vessel at a distance removed from the bottom 202 thereof, wherein the lower tubular section 204 of said vessel, extending around said vessel and having a height substantially extending from the lower edge 202 of said vessel to the lower edge 197 of opening 196 forms a closed hollow column as indicated by broken line 205 preventing water stored in the base of the cistern outside the column below level A from being discharged during high or low volume flushes.

As with the other preferred embodiments of the present invention there is provided a dual actuating means for the flushing mechanism which dual actuating means replaces the regular flush actuating means of said cistern. In the illustrated embodiment the first of said means comprises a mechanism for actuating the flushing mechanism as standarly found in such cisterns comprising a flushing knob 206 linked to a flushing lever 186 which lever is adapted to lift and pull chain 180 of the flush ball valve 168.

The second of said actuating means comprises a mechanism adapted to effect the pivoted displacement of the hinged door 198 of the vessel and to actuate the flushing mechanism and comprises a lever 208 coupled at one end to flushing handle 210 and having its other end 212 extending above the hinged door 198 of said vessel and attached thereto by means of a chain 214 to effect the pivotal displacement thereof.

It is to be noted that lever 208 is also situated below flushing lever 186 and is adapted upon actuation and displacement to push against and lift said flushing lever 186 thereby also actuating the flushing mechanism.

While in the preferred embodiment shown the lever mechanism 110 is of the type shown and described in detail with reference to FIGS. 2 and 4 it is of course possible to substitute and use the lever mechanism described with reference to FIGS. 1 and 3 adapted for interaction with loop head 171 of vertical stem 170.

From the above description and the description with regard to the previous figures it will now be understood that the arrangement of the device is such that upon insertion of said device 192 in said cistern and upon actuation of said first flush actuation means 206, 186, 180, 168 said door 198 remains in its initial closed rest position and the flushing action mainly utilizes only the water enclosed in the vessel and the water contained in the cistern between levels C and B above the level of said opening 194 at the upper end of the vessel, since in the closed position of the door 108 the linking arm 134 is adapted to slide alongside said lever arm 132 to the position shown in solid lines when said float lever 166 descends and in fact to contribute to the maintenance of the door in its closed position further assuring the creation of only a low volume flushing action for liquid wastes.

Upon actuation, however, of said second actuating means, lever 208 pivots around pivot point 216 and serves to lift flushing lever 186 while simultaneously pulling on chain 214 to dislodge hinged door 198 from its closed position whereafter the door 198 and the attached lever arm 132 swing open and the end 138 of said linking arm 134 bears against the notch 142 of the slot 140 of said lever arm 132 as a result of the descent of float lever 166 and retains said door in its open position as shown in broken lines. This open position of the door allows the rapid passage of the water contained in the cistern through the opening 194 at the upper end of the cistern, through the opened port 196 in the vessel created by the opening of door 198 and even via constantly open port 139 and out the water outlet 156 of the cistern whereby substantially all the water contained in the cistern bellow the lower edge 197 of opening 196 as well as the water enclosed in the vessel is utilized for a complete flushing action. After substantially all the water above level A and within the vessel has emptied from the cistern the ball valve 168 reseats itself and the cistern begins to refill with water whereafter the ascent of the float lever 166 and the resulting ascent of linking arm 134 attached thereto allows the release of said lever arm 132 from its displaced position and the closing of the door 198 by the virtue of the weight of said door as augmented by weight 118 and the influence of gravity thereon. Once said door is closed the cistern is once again ready to be selectively used for a low volume or a high volume flush as described.

It is to be noted that the embodiment shown can be considered as illustrating a vessel according to the present invention manufactured as a single unit and can also be viewed as illustrating the arrangement wherein an upper vessel 192 according to the present invention is affixed atop an existing sleeve-like column 204 to form a two tiered vessel having contiguous outer surfaces in which case it would be a simple matter to adapt said upper vessel 192 for attachment to said lower sleeve 204 by providing clamping and/or aligning brackets adapted to slide over and/or along the upper edge of said sleeve to securely affix said upper vessel to said lower sleeve.

While particular preferred embodiments of the invention have been described and shown in the drawings, it will be evident to those skilled in the art that the present invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A device for converting a single volume cistern into a selective volume cistern adapted to selectively allow both low volume and high volume flushes wherein said single volume-cistern is of the type having a water inlet, a water outlet, a flush actuating means, a flushing mechanism operationally linked to said water outlet, and a water level responsive means for controlling the amount of water flowing into the cistern, said device comprising a hollow vessel adapted to be inserted in said cistern surrounding the flushing mechanism and water outlet thereof, said vessel being provided with an opening at its upper end for the entry of water therethrough and with at least one selectively openable port, said openable port comprising a hinged door having a retaining lever mechanism, said lever mechanism comprising a lever arm attached at one of its ends to said door, said door and said lever arm being movable between a first closed position to a second displaced open position by said flush actuating means, said vessel forming an open ended water column extending above and around said water outlet to exclude a portion of the water in said cistern from passing through said outlet while said door is in said first closed position for low volume flushes; and restraining means operatively associated with said water level responsive means for restraining said lever mechanism to force said door, once opened, to remain in its open displaced position during the entire flushing action and until after the completion thereof for high volume flushes whereafter said arm is released from its displaced position and said door automatically swings shut to its initial closed position by virtue of its own weight.

2. The device as claimed in claim 1 wherein said door is weighted.

3. The device according to claim 1 wherein said water level responsive means includes a float lever, said lever mechanism is controlled by the position assumed by the float lever of the cistern, said restraining means releasing said lever arm and the hinged door from its open displaced position to enable its return to its initial closed rest position upon the refilling of the cistern and the effect of the rise in water level in said cistern on said float lever after the flushing mechanism has automatically closed said water outlet.

4. The device according to claim 3 wherein said lever mechanism further comprises a linking arm adapted to be attached to the float lever of the cistern wherein said linking arm and said lever arm are pivotally and slidingly coupled at their free ends to each other.

5. The device according to claim 4 wherein said lever is provided with a slot and said linking arm is pivotally and slidingly coupled to said slot in said lever arm; wherein when the door is in its closed position, the linking arm slides alongside said lever arm when said float lever descends, while when the door is in its displaced open position, said linking arm bears on said lever arm during the descent of said float whereby said lever arm forces said door to remain in its open displaced position until the ascent of the float and the linking arm attached thereto, upon the refilling of the cistern, allows the release of said lever arm from its displaced position and the closing of said door.

6. The device according to claim 5 wherein said lever arm is provided with a notched slot against which notch said linking arm bears when the door is in its displaced position and which notch is so positioned in said slot and with reference to said door as to assure the transmission of an adequate moment of force along said lever arm to maintain said door in its open position until after completion of the flushing action.

7. The device according to claim 6 wherein said notch is a stepped notch, wherein when the door is in its displaced open position said linking arm is slidingly guided by said slot to bear against said stepped notch.

8. A device according to claim 1 wherein said vessel comprises an integral bottom surface having a water outlet opening therein.

9. A device according to claim 8 wherein said hinged door when shut engages the vessel bottom in a tight friction fit.

10. A device according to claim 9 wherein the vertical distance from the hinged door's pivot point to the inner surface of the vessel bottom is less than the distance from said pivot point to the edge of the free end of said door.

11. A device according to claim 8 wherein said vessel further comprises means adapted for affixing said vessel in said cistern.

12. A device according to claim 11 wherein said means comprise apertures in the bottom of said vessel engaging projections extending from the bottom of said cistern.

13. A device according to claim 1 wherein upon insertion of the vessel into the cistern the bottom of the cistern serves as a common bottom to both the vessel and the cistern.

14. A device according to claim 1 wherein said single volume cistern further comprises a first sleeve-like vessel affixed to the bottom thereof forming an open-ended water column around the water outlet of said cistern wherein said device is attached atop said first sleeve-like vessel and in its closed rest position forms a contiguous outer surface with that of said first sleevelike vessel, whereby said device selectively allows both low volume and high volume flushes drawing substantially only from the water within said first vessel and the water above the upper edge of said first vessel.

15. A device according to claim 1 wherein said hinged door is positioned in a side of said vessel at a distance removed from the bottom thereof effectively forming a lower tubular section of said vessel extending around said vessel, said section having a height substantially extending from a lower edge of said vessel to the lower edge of said selectively openable port to form a closed hollow column around said water outlet preventing water stored in the base of the cistern outside said column from being discharged during the flushing thereof.

16. A device according to claim 1 wherein said flush actuating means of said cistern comprises a dual actuating means, the first of said means comprises a mechanism for actuating the flushing mechanism and the second of said actuating means comprises a mechanism adapted to effect the pivotal displacement of said hinged door and to actuate the flushing mechanism, wherein upon insertion of said device in said cistern and upon actuation of said first flush actuation means said door remains in its closed position and the flushing action mainly utilizes only the water enclosed in the vessel and the water contained in the cistern above the level of said opening at the upper end of the vessel, while upon actuation of said second actuating means said door is opened and said flushing mechanism is activated whereupon said restraining means retain said door in its open position until after the completion of the flushing action, thereby allowing the rapid entrance of the water contained in the cistern through said door opening and out the water outlet of the cistern whereby substantially all the water contained in the cistern above the lower edge of said door as well as the water enclosed in the vessel is utilized for the flushing action, whereafter said restraining means automatically release said door from its open position to enable its return to its initial closed rest position.

17. A device according to claim 16 wherein said second actuating means comprises a lever coupled at one end to a handle adapted to actuate the flushing mechanism and having its other end extending adjacent the hinged door of said vessel and adapted to push thereagainst and effect the pivotal displacement thereof.

* * * * *